United States Patent [19]

Lindberg

[11] Patent Number: 5,023,051

[45] Date of Patent: Jun. 11, 1991

[54] HYPOEUTECTIC ALUMINUM SILICON MAGNESIUM NICKEL AND PHOSPHORUS ALLOY

[75] Inventor: Richard S. Lindberg, Mt. Prospect, Ill.

[73] Assignee: Leggett & Platt Incorporated, Carthage, Mo.

[21] Appl. No.: 445,199

[22] Filed: Dec. 4, 1989

[51] Int. Cl.[5] ..... C22C 21/02

[52] U.S. Cl. ..... 420/549; 420/550

[58] Field of Search ..... 420/549, 550

[56] References Cited

U.S. PATENT DOCUMENTS

| | | | |
|---|---|---|---|
| 1,871,607 | 8/1932 | Hall et al. | 420/535 |
| 1,940,922 | 12/1933 | Sterner-Rainer | 420/548 |
| 2,155,651 | 4/1939 | Goetzel | 419/2 |
| 3,726,666 | 4/1973 | Desre et al. | 75/68 R |
| 3,841,919 | 10/1974 | Hasegawa et al. | 148/2 |
| 3,953,202 | 4/1976 | Rasmussen | 420/548 |
| 4,108,646 | 8/1978 | Gennone et al. | 420/549 |
| 4,147,074 | 4/1979 | Noguchi et al. | 74/559 |

*Primary Examiner*—Olik Chaudhuri
*Assistant Examiner*—Felisa Garrett
*Attorney, Agent, or Firm*—Wood, Herron & Evans

[57] ABSTRACT

A hypoeutectic aluminum silicon magnesium alloy includes 4–5.5% silicon, 0.15–3.5% magnesium, 0.005 to 0.08% phosphorus and aluminum. The presence of the phosphorus causes formation of a spherical percipitates of silicon magnesium and the aluminum. The phosphorus suppresses the magnesium silicon aluminum eutectic which allows the aluminum to remain liquid for a longer period of time and consequently providing a better fill of casting during the time the alloy is solidifying in a die or a mold. This alloy which preferably includes nickel is particularly useful for marine, hydraulic and refrigeration components.

8 Claims, No Drawings

HYPOEUTECTIC ALUMINUM SILICON MAGNESIUM NICKEL AND PHOSPHORUS ALLOY

BACKGROUND OF THE INVENTION

Aluminum for some time has been alloyed with various amounts of silicon. Based on the percentage content of silicon, the alloy can be characterized as a hypereutectic or hypoeutectic alloy. A hypoeutectic mixture is one which contains more aluminum than aluminum silicon eutectics. A hypereutectic alloy is therefore one which has more silicon than aluminum silicon eutectic.

The hypereutectic alloy is saturated with silicon thus having excess free silicon. Frequently magnesium is added to such hypoeutectic as well as hypereutectic alloys. For example, Goetzel U.S. Pat. No. 2,155,651 and Hall U.S. Pat. No. 1,871,607 both disclose hypoeutectic aluminum silicon magnesium alloys. Hypereutectic aluminum silicon alloys are disclosed, for example, in Hasegawa et al U.S. Pat. No. 3,841,919, Rasmussen U.S. Pat. No. 3,953,202 and Sterner-Rainer U.S. Pat. No. 1,940,922 which discloses an aluminum silicon magnesium alloy which has 5–40% silicon. A silicon content of 5–40% includes hypoeutectics and hypereutectics.

Phosphorus has also been added to hypereutectic aluminum silicon alloys. Its use is disclosed in the Sterner-Rainer reference. Further, Noguchi U.S. Pat. No. 4,147,074 discloses the addition of phosphorus to hypereutectic aluminum silicon alloys, but indicates that phosphorus is not required where the alloy contains less than 14% silicon. On the other hand, Desre U.S. Pat. No. 3,762,660 teaches the need to dephosphorize aluminum.

SUMMARY OF THE INVENTION

The present invention is premised upon the realization that a hypoeutectic aluminum silicon magnesium alloy can be formulated having substantially improved physical characteristics by adding an effective amount of phosphorus to the aluminum silicon magnesium alloy whereby the aluminum silicon magnesium precipitate forms around the phosphorus atom in a spherical formation. This enables the alloy to remain in a liquid state for a longer period of time enabling it to efficiently and effectively fill a mold prior to solidification for improved density.

Further, the strength of this alloy is comparable to aluminum alloys which are significantly more expensive. Such an alloy can be cast at lower temperature which in turn reduces the expense of using this alloy.

These advantages are particularly realized an alloy having the following components:

| | |
|---|---|
| Silicon | 4.0–5.5% |
| Iron | .5% Max. |
| Magnesium | .15–.35% |
| Copper | .60% Max. |
| Zinc | .30% Max. |
| Nickel | .30–.50% |
| Lead | .1% Max. |
| Tin | .1% Max. |
| Titanium | .15% Max. |
| Chromium | .05% Max. |
| Phosphorus | .005–.008% |

Such an alloy is particularly useful in forming marine, hydraulic and refrigeration components.

DETAILED DESCRIPTION

The present invention is a hypoeutectic aluminum silicon magnesium alloy incorporating an effective amount of phosphorus to cause the formation of aluminum silicon magnesium precipitate in a spherical formation. As with most aluminum alloys, the primary component of the present invention is aluminum. In the present application all percentages are given in terms of weight percentages unless otherwise specified.

The hypoeutectic alloy of the present invention being a hypoeutectic includes less than 12% silicon and generally less than 10% silicon. Further, the advantages of the present invention are appreciated generally only when the silicon content exceeds 4%. At less than 4% the silicon magnesium aluminum precipitate simply does not form.

The alloy or the present invention further includes magnesium and specifically less than 1% magnesium. When the magnesium exceeds 1% the alloy becomes over modified and very sluggish lacking various mechanical properties. Generally there should be at least 0.1% magnesium in order to form the magnesium aluminum silicon precipitate and generally 0.15 to 0.35% magnesium is preferred.

In order that the aluminum silicon magnesium eutectic forms as a spherical precipitate phosphorus must also be added. Generally at least about 0.05% phosphorus will be added to the melt. Since phosphorus is unstable most of this (about 90%) will burn off leaving about 10% residual phosphorus in the alloy. It is important that there not be so much phosphorus that there would be an excess of 0.01% residual phosphorus. Residual phosphorus refers to phosphorus present in the alloy either part of the aluminum magnesium silicon precipitate or the aluminum matrix. Once the residual phosphorus content exceeds 0.01 it will actually have an opposite effect on the composition interfering with the eutectic formation. Generally it is preferred that there be no more than about 0.008% residual phosphorus in the casting. Thus the residual content of phosphorus in the casting is maintained at about 0.005 to about 0.008%. To accomplish this, generally 0.05 to about 0.08% phosphorus is added to the initial mixture.

The alloy of the present invention preferably includes an effective amount of nickel which acts much like a plasticizing agent increasing the toughness of the formed alloy. Generally this can in present up to about 0.5% generally from about 0.3% to about 0.5%.

Accordingly, in a preferred embodiment, the present invention is formed by combining the following components

| | |
|---|---|
| Silicon | 4.0–5.5% |
| Iron | .5% Max. |
| Magnesium | .15–.35% |
| Manganese | .25% Max. |
| Copper | .60% Max. |
| Zinc | .30% Max. |
| Nickel | .30–.50% |
| Lead | .1% Max. |
| Tin | .1% Max. |
| Titanium | .15% Max. |
| Chromium | .05% Max. |
| Phosphorus | .05–.08% |

with the balance being aluminum.

The alloy of the present invention is formed by combining all the components with the exception of phosphorus. These are melted and mixed in an appropriate furnace such as reverberatory furnace or an induction type furnace. Once all the components are melted and mixed the pumps or other mixing devices are stopped and the phosphorus generally elemental phosphorus is added to the melt and mixed with an inert gas such as nitrogen. About 90% of the added phosphorus burns off. After an adequate mixing time, the melt is tapped and the alloy cast into ingots. Generally the alloy is formed at temperatures from about 1300° to about 1400° F.

EXAMPLE

In order to compare the alloy of the present invention with commercially available 714–214 type alloys, an alloy made according to the present invention was formed by combining the following elements

| | |
|---|---|
| Silicon | 4.96% |
| Magnesium | .30% |
| Iron | .43% |
| Manganese | .01% |
| Zinc | .18% |
| Copper | .14% |
| Nickel | .30% |
| Phosphorus | .06% |
| Tin | .02% |
| Lead | .01% |
| Titanium | .01% |
| Chromium | .01% |

This leaves about 0.006% residual phosphorus. The average tensile strength of the alloy was 33,600 psi with an average yield strength of 20,300 psi and average elongation of 6.0%. This compared to a 714 aluminum alloy having an average tensile strength of 32,700 psi, average yield strength of 20,300 psi and an average elongation of 6.5%.

Both the alloy of the present invention and the 714 alloy were subjected to a load test (Blade Break Test Propellor). As cast, the 714 alloy withstood 1210 lbs. and the alloy of the present invention withstood 1230 lbs. After 3 weeks, the 714 alloy withstood 1950 lbs. whereas the alloy of the present invention withstood 2050 lbs.

An alloy formed according to the present invention has physical characteristics comparable to a 714–214 type aluminum alloy, but at the same time is less expensive and requires less energy to process. It has a casting temperature approximately 200° F. less than the casting temperature of a 714 alloy. Further, due to the formation of basically spherical aluminum silicon magnesium eutectic, it remains liquid for a longer period of time thus allowing for a more uniform filling of a mold. Also due to this physical nature, it does not erode the dies as easily as a 714 type alloy.

The above has been a description of how to make and practice the present invention along with the description of the preferred embodiment.

However, the invention should be limited only by the appended claims wherein I claim:

1. A hypoeutectic aluminum silicon magnesium alloy comprising

4–10% silicon, 0.15–1% magnesium, from about 0.005% to about 0.01% phosphorus and aluminum wherein said alloy has a spherical aluminum silicon magnesium phosphorus precipitate.

2. The alloy claimed in claim 1 wherein said alloy has less than 0.008% phosphorus.

3. The alloy claimed in claim 1 wherein said alloy has from about 4.0 to about 5.5% silicon.

4. The alloy claimed in claim 3 wherein said alloy has from about 0.3 to about 0.5% nickel.

5. The alloy claimed in claim 4 wherein said alloy has from about 0.15 to about 0.35% magnesium.

6. A hypoeutectic aluminum silicon magnesium nickel alloy comprising aluminum and

| | |
|---|---|
| Silicon | 4.0–5.5% |
| Iron | .5% Max. |
| Magnesium | .15–.35% |
| Manganese | .25% Max. |
| Copper | .60% Max. |
| Zinc | .30% Max. |
| Nickel | .30–.50% |
| Lead | .1% Max. |
| Tin | .1% Max. |
| Titanium | .15% Max. |
| Chromium | .05% Max. |
| Phosphorus | .005–.008%. |

7. A hypoeutectic aluminum silicon magnesium nickel alloy consisting essentially of

| | |
|---|---|
| Silicon | 4.0–5.5% |
| Iron | 5% Max. |
| Magnesium | .15–.35% |
| Manganese | .25% Max. |
| Copper | .60% Max. |
| Zinc | .30% Max. |
| Nickel | .30–.50% |
| Lead | .1% Max. |
| Tin | .1% Max. |
| Titanium | .15% Max. |
| Chromium | .05% Max. |
| Phosphorus | .005–.008% |

with the balance being aluminum.

8. A hypoeutectic aluminum silicon alloy formed from aluminum and

| | |
|---|---|
| Silicon | 4.0–5.5% |
| Iron | .5% Max. |
| Magnesium | .15–.35% |
| Manganese | .25% Max. |
| Copper | .60% Max. |
| Zinc | .30% Max. |
| Nickel | .30–.50% |
| Lead | .1% Max. |
| Tin | .1% Max. |
| Titanium | .15% Max. |
| Chromium | .05% Max. |
| Phosphorus | .05–.08%. |

* * * * *

UNITED STATES PATENT AND TRADEMARK OFFICE

CERTIFICATE OF CORRECTION

PATENT NO. : 5,023,051

DATED : June 11, 1991

INVENTOR(S) : Richard S. Lindberg

It is certified that error appears in the above-identified patent and that said Letters Patent is hereby corrected as shown below:

In column 4, line 34, "5" should be --.5%--.

Signed and Sealed this

Thirteenth Day of October, 1992

*Attest:*

DOUGLAS B. COMER

*Attesting Officer*

*Acting Commissioner of Patents and Trademarks*